US012440717B2

(12) United States Patent
Herring et al.

(10) Patent No.: US 12,440,717 B2
(45) Date of Patent: Oct. 14, 2025

(54) VARIABLE-RESISTANCE CABLE TRAINING ASSEMBLY AND METHODS OF USE

(71) Applicant: Anchor Health & Fitness, Inc., Salem, MA (US)

(72) Inventors: Arthur N. Herring, Salem, MA (US); Paul J. Kenney, Beverly, MA (US); Zachary D. Caplin, Salem, MA (US); Isaac E. H. Lewis, Windsor (CA)

(73) Assignee: Anchor Health & Fitness, Inc., Salem, MA (US)

( * ) Notice: Subject to any disclaimer, the term of this patent is extended or adjusted under 35 U.S.C. 154(b) by 0 days.

(21) Appl. No.: 18/952,474

(22) Filed: Nov. 19, 2024

(65) Prior Publication Data

US 2025/0177800 A1 Jun. 5, 2025

Related U.S. Application Data

(60) Provisional application No. 63/604,334, filed on Nov. 30, 2023.

(51) Int. Cl.

| | |
|---|---|
| ***A63B 21/00*** | (2006.01) |
| ***A63B 21/02*** | (2006.01) |
| ***A63B 21/04*** | (2006.01) |
| ***A63B 21/045*** | (2006.01) |

(52) U.S. Cl.

CPC ..... *A63B 21/153* (2013.01); *A63B 21/00069* (2013.01); *A63B 21/023* (2013.01); *A63B 21/0435* (2013.01); *A63B 21/0455* (2013.01)

(58) Field of Classification Search

CPC ..... A63B 21/153; A63B 21/00069; A63B 21/023; A63B 21/0435; A63B 21/0455

See application file for complete search history.

(56) References Cited

U.S. PATENT DOCUMENTS

| | | | | |
|---|---|---|---|---|
| 5,486,149 | A * | 1/1996 | Smith | A63B 21/4043 482/904 |
| 6,149,559 | A * | 11/2000 | Mackey | A63B 21/16 482/904 |
| 6,659,922 | B1 * | 12/2003 | Yu | A63B 21/0004 482/121 |
| 7,087,001 | B1 * | 8/2006 | Ihli | A63B 21/015 D30/153 |
| 7,775,936 | B2 * | 8/2010 | Wilkinson | A63B 21/4035 482/8 |
| 8,556,783 | B1 * | 10/2013 | Ihli | A63B 21/4035 482/44 |
| 10,220,261 | B1 * | 3/2019 | Garsdean | A63B 24/0087 |

(Continued)

OTHER PUBLICATIONS

International Search Report and Written Opinion issued in International Application No. PCT/US2024/057018 on Mar. 24, 2025, 11 pages.

*Primary Examiner* — Andrew S Lo

(74) *Attorney, Agent, or Firm* — ArentFox Schiff LLP; Joseph M. Maraia; Marlo S. Grolnic

(57) ABSTRACT

A cable training assembly disposable within a portable housing includes a cable configured for pulling by a user and a screw mechanism configured to deflect at least one spring. The deflection of the spring exerts a retraction force on the cable in opposition to a force exerted on the cable by the user. A selector assembly includes a knob that is rotatable by the user to select or deselect a spring acting on the cable.

13 Claims, 10 Drawing Sheets

(56) References Cited

U.S. PATENT DOCUMENTS

| | | | | |
|---|---|---|---|---|
| 10,512,812 | B2 * | 12/2019 | Krull | A63B 21/4043 |
| 12,201,869 | B2 * | 1/2025 | Wallander | A63B 21/0442 |
| 2002/0025891 | A1 * | 2/2002 | Colosky, Jr. | A63B 23/00 482/127 |
| 2002/0086779 | A1 * | 7/2002 | Wilkinson | A63B 23/1263 482/118 |
| 2004/0152571 | A1 | 8/2004 | Udwin | |
| 2012/0322635 | A1 * | 12/2012 | Carter | A63B 21/0442 482/129 |
| 2013/0203558 | A1 * | 8/2013 | Lemos | A63B 21/154 482/93 |
| 2015/0080195 | A1 | 3/2015 | Yeh | |
| 2016/0332021 | A1 * | 11/2016 | Smith | A63B 21/0442 |
| 2017/0056702 | A1 * | 3/2017 | Carter | A63B 21/0442 |
| 2020/0069993 | A1 * | 3/2020 | Kumelis | A63B 21/008 |
| 2021/0322813 | A1 | 10/2021 | Lagree et al. | |
| 2021/0339078 | A1 | 11/2021 | Akeel et al. | |
| 2022/0023702 | A1 | 1/2022 | Watterson | |
| 2022/0168606 | A1 * | 6/2022 | Herring | A63B 21/153 |
| 2022/0339481 | A1 * | 10/2022 | Peal | A63B 21/015 |
| 2023/0001259 | A1 * | 1/2023 | Simenthi | A63B 21/157 |
| 2023/0211202 | A1 * | 7/2023 | Gulick | A63B 23/03541 482/121 |
| 2023/0241447 | A1 * | 8/2023 | Canole | A63B 21/025 482/121 |
| 2024/0082622 | A1 * | 3/2024 | Sherin | A63B 21/025 |

* cited by examiner

VARIABLE-RESISTANCE CABLE TRAINING ASSEMBLY AND METHODS OF USE

CROSS-REFERENCE TO RELATED APPLICATIONS

This application claims priority to and benefit of U.S. Provisional Application No. 63/604,334, filed Nov. 30, 2023, entitled VARIABLE-RESISTANCE CABLE TRAINING ASSEMBLY AND METHODS OF USE, the entire contents of which are incorporated herein by reference for all purposes.

FIELD

The present disclosure generally relates to exercise devices and, more particularly, to cable-based, portable exercise devices that are selectively adjustable to provide variable resistance levels.

BACKGROUND

Conventional resistance-based workout devices are used for exercise, strength training, and physical therapy. Such workout devices often include either physical or simulated weights to resist the motion of a cable pulled by a user. Physically weighted workout devices often include a vertically aligned frame that accommodates a weight stack attached via a cable-and-pulley system, with purchases ranging from 1:1 to 4:1. The cable runs through a pulley system with an adjustable user outlet to allow the user to pull the handle from various heights. The user selects the desired resistance by inserting a fastener (e.g., a pin or other type of locking mechanism) into one of the weights in the stack and that weight, along with all overlying weights, provides resistance to the cable. The user end of the cable generally forms a loop for allowing the user to attach an appropriate handle for the desired exercise. Simulated weight workout devices generally provide either mechanical resistance through use of an array of spring mechanisms that the user can select in varying quantities to change the cable's resistance, or electronic resistance through the use of a motor coupled to a cable spool.

Although effective for providing resistance, conventional workout devices have many shortcomings. For example, physically weighted workout devices are often large, having dimensions of between 6-8 feet wide, 7-8 feet tall, and 3-5 feet deep. The workout devices are often heavy and, depending on how many weights are included in the weight stack, can weigh up to 1,700 pounds. Therefore, such conventional workout devices usually require substantial space to store in a home setting. The heavy and bulky nature of these conventional workout devices also makes them difficult to transport or relocate. Mechanical resistance devices may require a user's prior knowledge of how to use the device. Electronic resistance designs may require continual battery charging and/or proximity to an electronic outlet, creating a potential tripping hazard.

SUMMARY

Given the shortcomings of conventional resistance-based workout devices, there is a need for resistance-based workout devices that can vary resistance, adapt to a wide range of spaces, be used without prior knowledge, and be easy for a user to move unassisted between storage and the user's preferred exercise location. The presently disclosed devices solve these and other shortcomings by providing a cable training assembly disposable within a portable housing that includes a cable configured for actuation by a user and a screw mechanism configured to deflect at least one spring. The deflection of the spring exerts a retraction force on the cable. A selector assembly has a knob that allows the user to select and deselect one or more springs acting on the cable via an intermittent gear system. The screw mechanism advantageously provides the exercise device with a smooth motion, the ability to support and resist high radial loads without binding, and limited user maintenance. The springs advantageously contribute to the long-life span and the high load-to-size ratio of the device.

Embodiments of the cable training assembly of this disclosure may include one or more of the following, in any suitable combination.

A cable training assembly of this disclosure may include a cable configured for pulling by a user. A screw mechanism operatively couples to the cable. The screw mechanism is configured to deflect at least one spring. The deflection of the at least one spring exerts a retraction force on the cable.

In further embodiments, the cable training assembly is disposed within a portable housing. In embodiments, the screw mechanism is a ball screw assembly having a threaded ball screw at least partially extending through an internally threaded ball nut. In embodiments, the cable is wound about a spool mounted to the screw mechanism such that the pulling of the cable by the user causes rotational and translational movement of the spool relative to the ball screw. In embodiments, the cable is wound about a spool mounted to the screw mechanism such that the pulling of the cable by the user causes rotational and translational movement of the spool relative to the ball nut. In embodiments, a spool is mounted to one of the ball screw and the ball nut. In embodiments, the at least one spring is selectively engageable with a selector assembly. In embodiments, the selector assembly includes a user-engageable member, and adjustment of the user-engageable member selectively engages and disengages the at least one spring. In embodiments, the user-engageable member is a rotatable knob. In embodiments, the selector assembly selectively engages and disengages the at least one spring via an intermittent gearing system. In embodiments, the intermittent gearing system includes an outer gear on a knob of the selector assembly configured to engage a gear ring associated with the at least one spring. In embodiments, the at least one spring is a nitrogen spring. In embodiments, the deflection of the at least one spring includes compression of the at least one spring. In embodiments, the deflection of the at least one spring includes extension of the at least one spring.

Embodiments of a selector assembly of this disclosure for use with an exercise device including a cable training assembly, the cable training assembly including a cable and at least one spring, include a user-engageable member operatively coupled to at least one locking mechanism. The at least one locking mechanism is configured to selectively engage and disengage the at least one spring via an intermittent gearing system when a user adjusts the user-engageable member. The engagement of the at least one locking mechanism with the at least one spring causes deflection of the at least one spring. The deflection of the at least one spring exerts a retraction force on the cable. In embodiments, the user-engageable member is a rotatable knob. In embodiments, the selector assembly further includes a retainer member defining a bore configured to receive the at least one spring. The intermittent gearing system controls movement of a plurality of ball bearings into and out of the bore. In embodiments, the selector assembly is adjustable between a first position, in which the at least one spring is engaged with the plurality of ball bearings, and a second position, in which the at least one spring translates freely through the bore. In embodiments, when the cable is pulled by a user, the at least one spring is caused to deflect when the plurality of ball bearings are engaged with the at least one spring. In embodiments, when the cable is pulled by a user, the at least one spring is prevented from deflecting when the at least one spring travels freely through the bore.

A reading of the following detailed description and a review of the associated drawings will make apparent the advantages of these and other structures. Both the foregoing general description and the following detailed description serve as an explanation only and do not restrict aspects of the disclosure as claimed.

BRIEF DESCRIPTION OF THE DRAWINGS

Reference to the detailed description, combined with the following figures, will make the disclosure more fully understood, wherein.

DETAILED DESCRIPTION

Figure 1A:
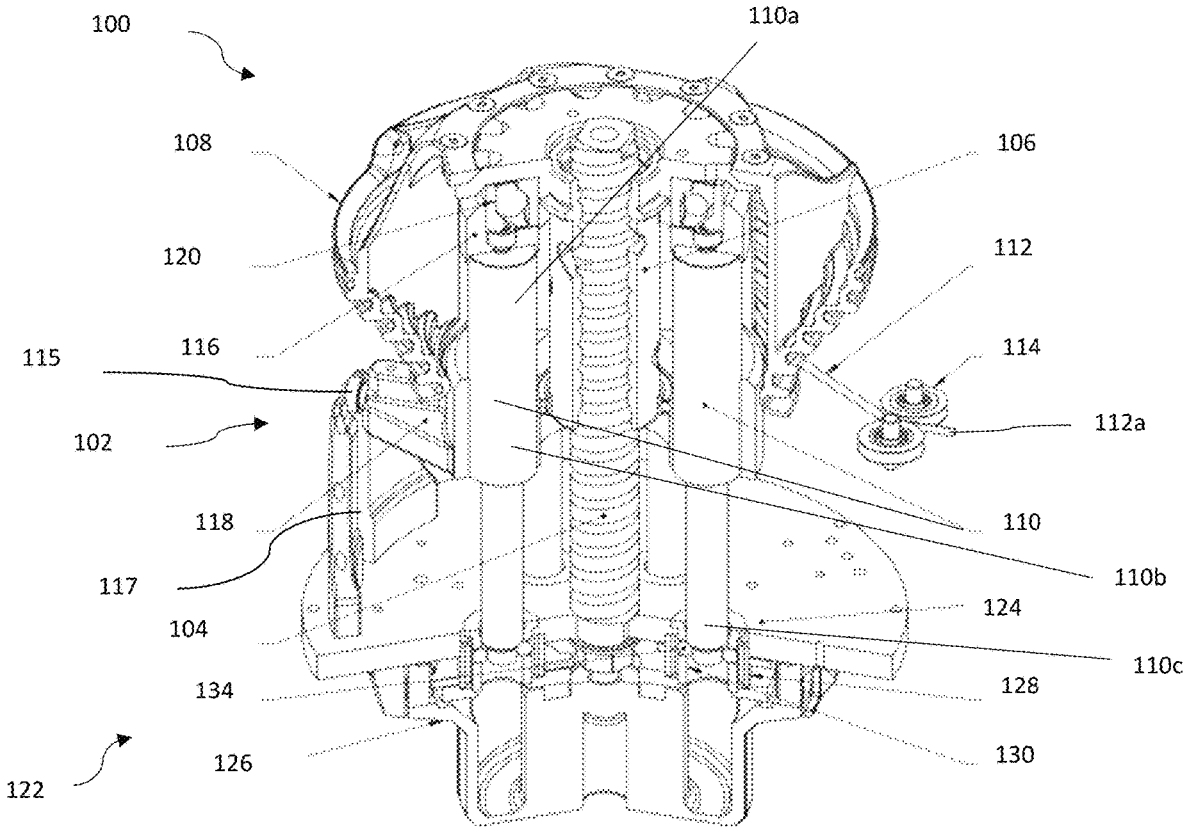
FIG. 1A illustrates a cut-away view of an exemplary cable training assembly configured in accordance with some embodiments of the subject disclosure.

The presently disclosed workout devices address several issues with previous designs. The workout devices are compact in size and lightweight, allowing for easy transport and use. Exemplary structures of the components of the disclosed workout devices and related methods are discussed in the following sections.

In the following description, like components have the same reference numerals, regardless of different illustrated embodiments. To illustrate embodiments clearly and concisely, the drawings may not necessarily reflect appropriate scale and may have certain structures shown in somewhat schematic form. The disclosure may describe and/or illustrate structures in one embodiment, and in the same way or in a similar way in one or more other embodiments, and/or combined with or instead of the structures of the other embodiments.

In the specification and claims, for the purposes of describing and defining the invention, the terms "about" and "substantially" represent the inherent degree of uncertainty attributed to any quantitative comparison, value, measurement, or other representation. The terms "about" and "substantially" moreover represent the degree by which a quantitative representation may vary from a stated reference without resulting in a change in the basic function of the subject matter at issue. Open-ended terms, such as "comprise," "include," and/or plural forms of each, include the listed parts and can include additional parts not listed, while terms such as "and/or" include one or more of the listed parts and combinations of the listed parts. Use of the terms "top," "bottom," "above," "below" and the like helps only in the clear description of the disclosure and does not limit the structure, positioning and/or operation of the disclosure in any manner.

FIG. 1A illustrates a cut-away view of a resistance-based cable training assembly 100 configured in accordance with some embodiments of the subject disclosure. Components of the assembly 100 may be at least partially disposed within a housing of a portable exercise device, which is omitted from the drawings for ease of illustration. The housing may comprise any suitable structure sized and shaped for holding and protecting the components of the assembly 100. The housing may also include one or more mounting elements for mounting the assembly 100 to a mounting surface, such as a wall.

As shown in FIG. 1A, the assembly 100 may include a screw mechanism configured to convert rotational motion to linear motion and rotational force (i.e., torque) into linear force. For example, the assembly 100 may include a ball screw assembly 102, which may comprise a threaded ball screw 104 at least partially extending through an internally threaded ball nut 106. The ball screw 104 may be fixed relative to a base unit 124 and may have a selected thread pitch such that rotation of the ball nut 106 causes the ball nut 106 to both rotate and translate relative to the ball screw 104 to compress or otherwise deflect a plurality of springs 110 mounted to the ball nut 106, as further described below. In embodiments, each of the plurality of springs 110 may have a different level of resistance from another spring 110.

While the exemplary embodiment discloses a ball screw 104, the disclosure also contemplates the use of other types of screws, such as leadscrews, roller screws or other forms of ball screw. Embodiments of the screw-like motion could also include rollers or cam followers riding in a helical shaped track on the outside of the spool. Embodiments of the plurality of springs 110 may include a plurality of springs 110 (for example, five springs 110 as shown, or six springs 110) arranged equidistantly about the ball screw 104, as shown. However, the disclosure contemplates more or fewer than five or six springs 110, and spacing arrangements other than equidistant. Embodiments of the springs 110 may be nitrogen die springs. However, the disclosure contemplates other suitable springs 110, such as other types of compression springs, other forms of gas springs, or hydraulic springs. Embodiments of the springs 110 may include springs 110 with and without damping. Embodiments of the springs 110 may also include extension springs, such that the deflection of the spring 110 includes extension rather than compression of the spring 110. Embodiments of the springs 110 can further include rotational springs such as torsion springs, power springs, or constant force springs. Embodiments of the springs can also include cantilevered or clutch-style springs, such as leaf springs, one-sided leaf springs, or diaphragm springs.

Still referring to FIG. 1A, a reel or spool 108 may mount to the ball nut 106 and may be configured to store a rope or cable 112 wound about an exterior surface of the spool 108. The spool 108 may be configured to convert the linear pull of the cable 112 into the torque required to rotate the ball nut 106 relative to the ball screw 104. For example, one end (not shown) of the cable 112 may be secured to the spool 108, while an opposite end 112*a* may be configured to attach to a handle or grip to be pulled by a user. Embodiments of the spool 108 may have a tapered design that allows the spool 108 to compensate for the rise in force from the springs 110 as they deflect. A roller assembly 114 may be configured to ensure that the cable 112 properly rolls onto and off from the spool 108. The roller assembly 114 may also be configured to allow the user to pull the cable 112 in different directions while reducing friction on the cable 112. Embodiments of the roller assembly 114 may be formed as an integrated part of the housing. The cable 112 may be constructed from any suitable material(s) and, in some embodiments, may be implemented with a material having high strength, flexibility, and a low ability to stretch. A first end 110*a* of the plurality of springs 110 may be attached to the ball nut 106 via a first mount 116. A spring-nut bearing 120 may be mounted between the ball nut 106 and the first end 110*a* of the springs 110. A middle portion 110*b* of the spring 110 may also be attached to the housing by a second mount 118 that includes a cam follower 115 and track 117, while a second end 110*c* of the spring 110 may be slidable with respect to a retainer member 130 of a locking mechanism. A selector assembly 122 may include a user-engageable member, such as a knob 126, mounted to the housing beneath the base unit 124. The knob 126 may selectively couple to one or more of a plurality of gear rings 128 via an intermittent gearing system, as further described below. An outer surface of the knob 126 may include indicia (not shown) allowing the user to select an amount of retraction force to be exerted by the spring 110 on the cable 112 as the user adjusts (e.g., rotates) the knob 126.

Figure 1B:
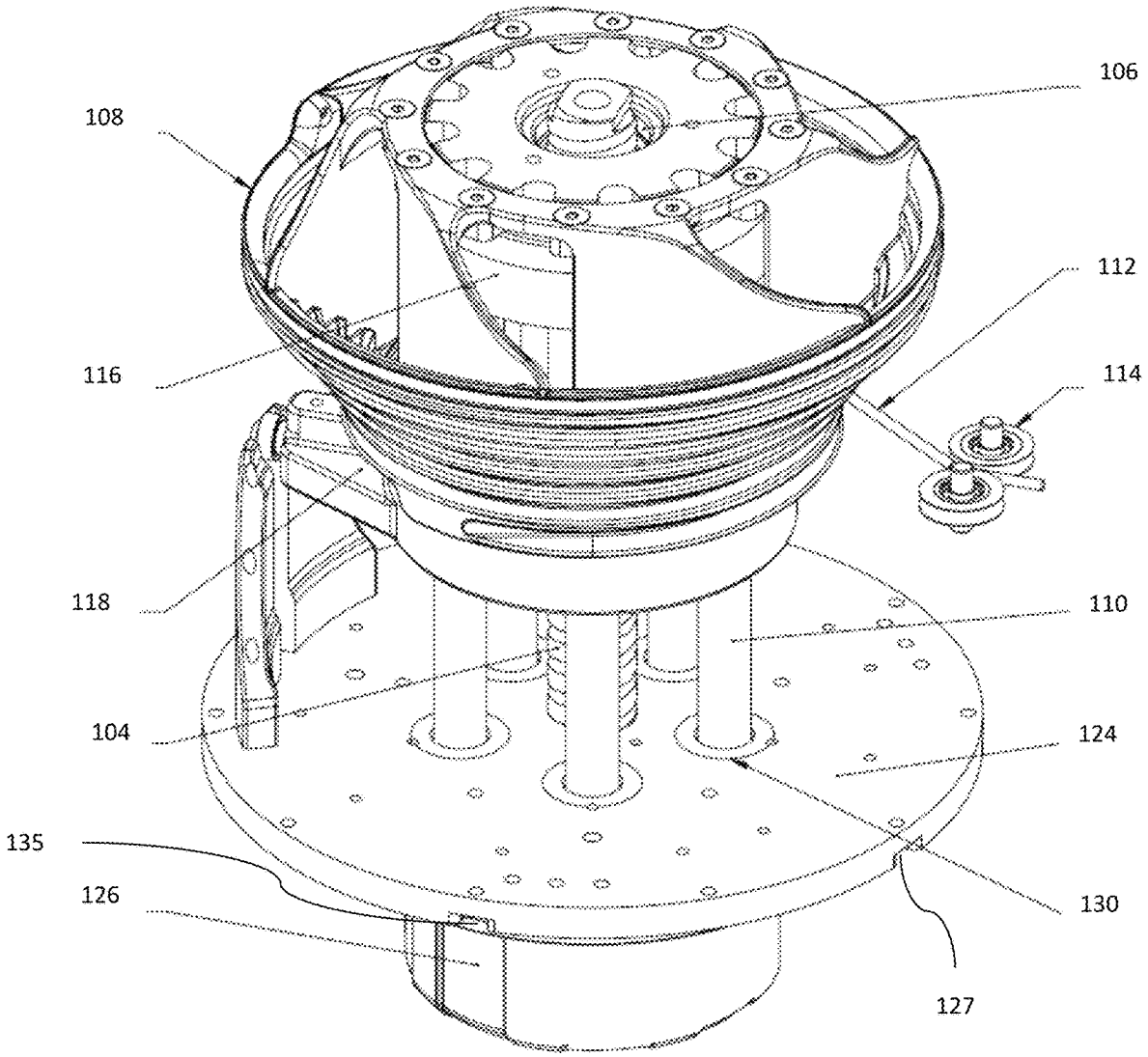
FIG. 1B illustrates a dimetric view of the exemplary cable training assembly of FIG. 1A.

FIG. 1B illustrates a dimetric view of the assembly 100 of FIG. 1A. As shown in FIG. 1B, an outer surface of the base unit 124 may include a plurality of openings 127 configured to receive a corresponding tab 135 on the knob 126. Engagement of the tab 135 with the opening 127 allows the knob 126 to lock into place relative to the base unit 124.

Figure 2:
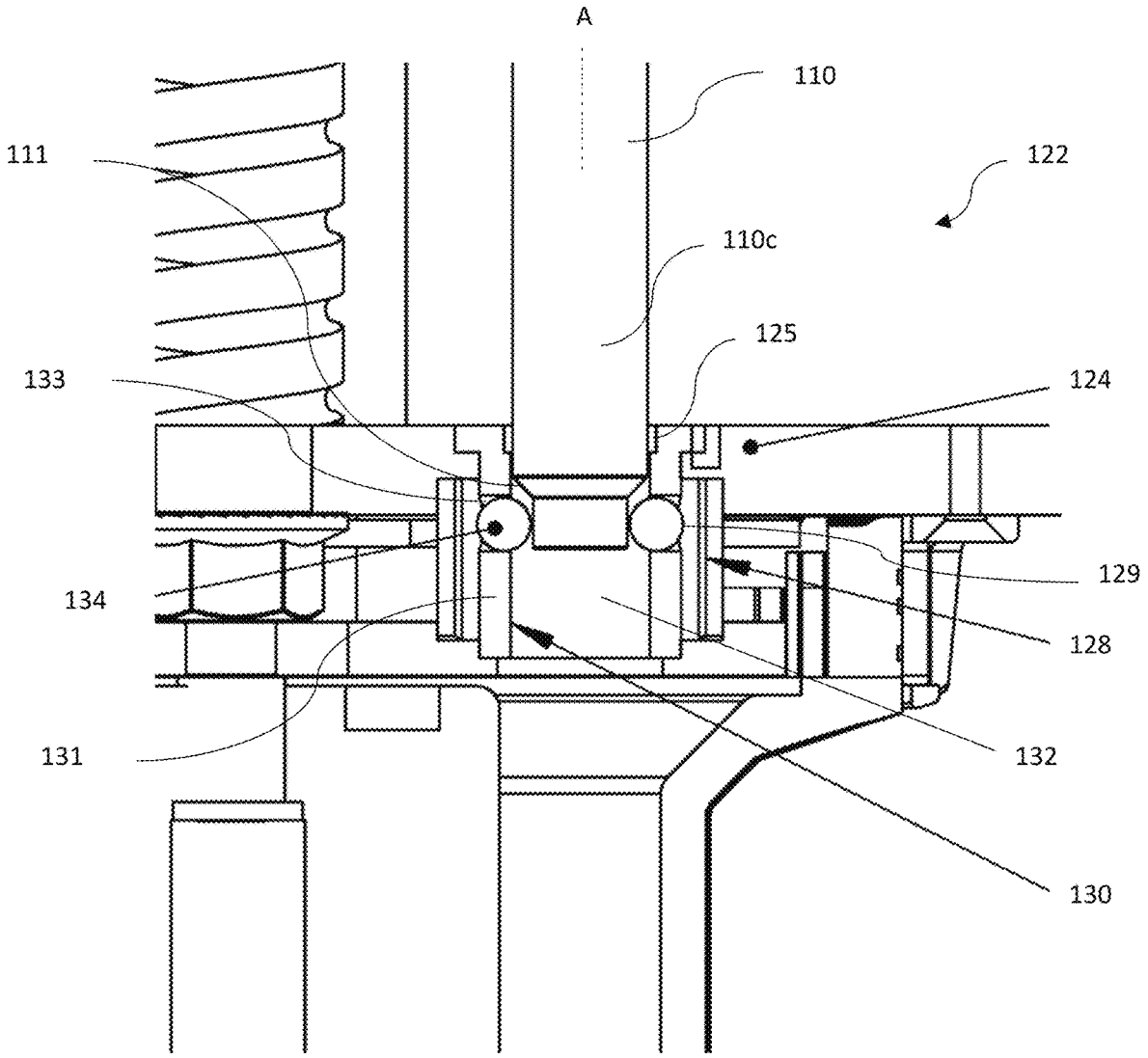
FIG. 2 illustrates a detailed view of the components of the selector assembly shown in FIG. 1A.

FIG. 2 illustrates a detailed view of the components of the selector assembly 122 shown in FIG. 1A. As shown in FIG. 2, the gear ring 128 of the selector assembly 122 may be configured to rotate the retainer member 130 a predetermined number of degrees of rotation. The retainer member 130 may define a bore 132 extending along a central axis A of the spring 110 and configured to receive one of the plurality of springs 110 as it extends through an opening 125 in the base unit 124. A wall 131 of the retainer member 130 may define a plurality of holes 133 aligned radially about the central axis A and configured for passage of a ball bearing 134 towards and away from the bore 132. For example, the wall 131 of the retainer member 130 may define four holes 133, as shown. However, the disclosure contemplates more or fewer than four holes 133. The second end 110*c* of the spring 110 may further define a curved or tapered region 111 for engaging the ball bearings 134 when the ball bearings 134 partially extend into the bore 132. An interior surface of the retainer member 130 may further include a groove 129 for receiving the ball bearing 134 as it moves away from the bore 132.

Figure 3:
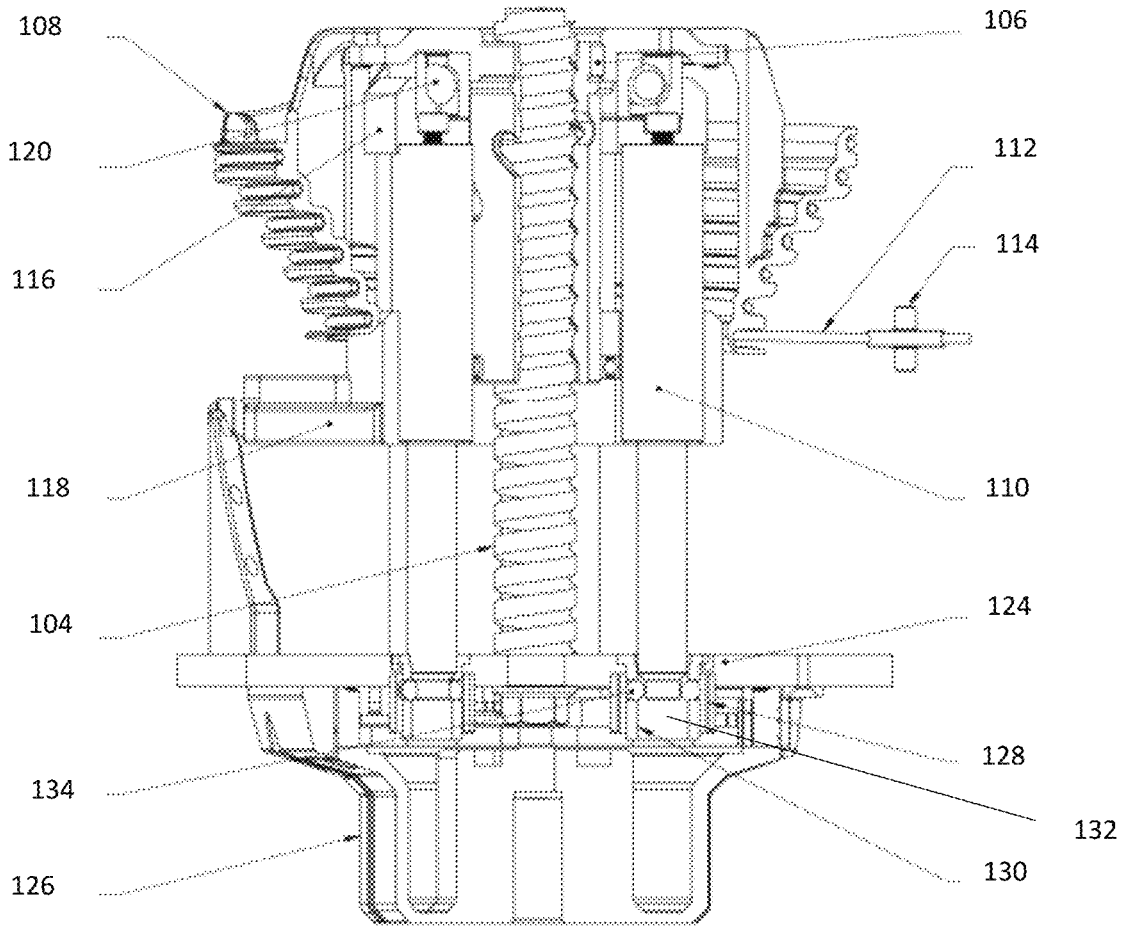
FIG. 3 illustrates a side cut-away view of the exemplary cable training assembly shown in FIG. 1A.

FIG. 3 illustrates a side cut-away view of the assembly 100 as shown in FIG. 1A. FIG. 3 illustrates, for example, the plurality of springs 110 housed inside of the spool 108. The ball screw 104 may fixedly couple to the base unit 124, while the spring-nut bearing 120 may couple to both the spool 108 and the ball nut 106. The springs 110 may partially extend into the bore 132 of the retainer members 130. FIG. 3 shows the cable 112 in a fully retracted state, with no user-driven force applied to the plurality of springs 110. However, as the user pulls on the free end of the cable 112 via a handle or grip attached to the cable 112, the tension applied to the cable 112 may cause the cable 112 to unwind from the spool 108, starting at the lowest portion of the spool 108 and proceeding upwards. This unwinding in turn may cause the spool 108 and the attached ball nut 106 to rotate and translate relative to the ball screw 104. As the ball nut 106 rotates and translates, it may apply an axial and tangential load to the spring-nut bearing 120. Because the first mount 116 is coupled to the spool 108 via the spring-nut bearing 120 and aligned rotationally via the cam follower 115 and track 117 (FIG. 1A), rotation from the tangential load may be eliminated, allowing the springs 110 to move linearly without rotation. The axial movement of each of the plurality of springs 110 may deflect the spring 110 between the spring-nut bearing 120 and the ball bearings 134 if the selector assembly 122 is in the engaged position for that particular spring 110, as shown. The unselected springs 110 will continue to translate axially into the bore 132 of the retainer member 130 and will not deflect. In some embodiments, one of the retainer members 130 (for example, a sixth retainer member 130) may be configured without ball bearings such that the corresponding spring 110 freely translates through the bore 132 without deflection. Deflection of the springs 110 may generate a retraction force on the cable 112 due to the ball screw assembly 102 generating directly opposing forces to those forces that the user generates by pulling the cable 112. When the opposing reaction forces generated by deflection of the springs 110 are greater than those generated by the user's pulling of the cable 112, the spool 108 may move in a reverse translational and rotational direction, causing the cable 112 to rewind about the spool 108.

FIGS. 4A-4D schematically illustrate the movement and positioning of a locking mechanism of the selector assembly 122 during use. Specifically, FIGS. 4A-4D illustrate the differences in the mechanical position of the springs 110, the ball bearings 134, the gear ring 128, and the retainer members 130 between the engaged and disengaged positions of the selector assembly 122. The selector assembly 122 may work by controlling a predetermined arrangement of the springs 110 that equates to the total resistance level applied to the cable 112.

Figure 4A:
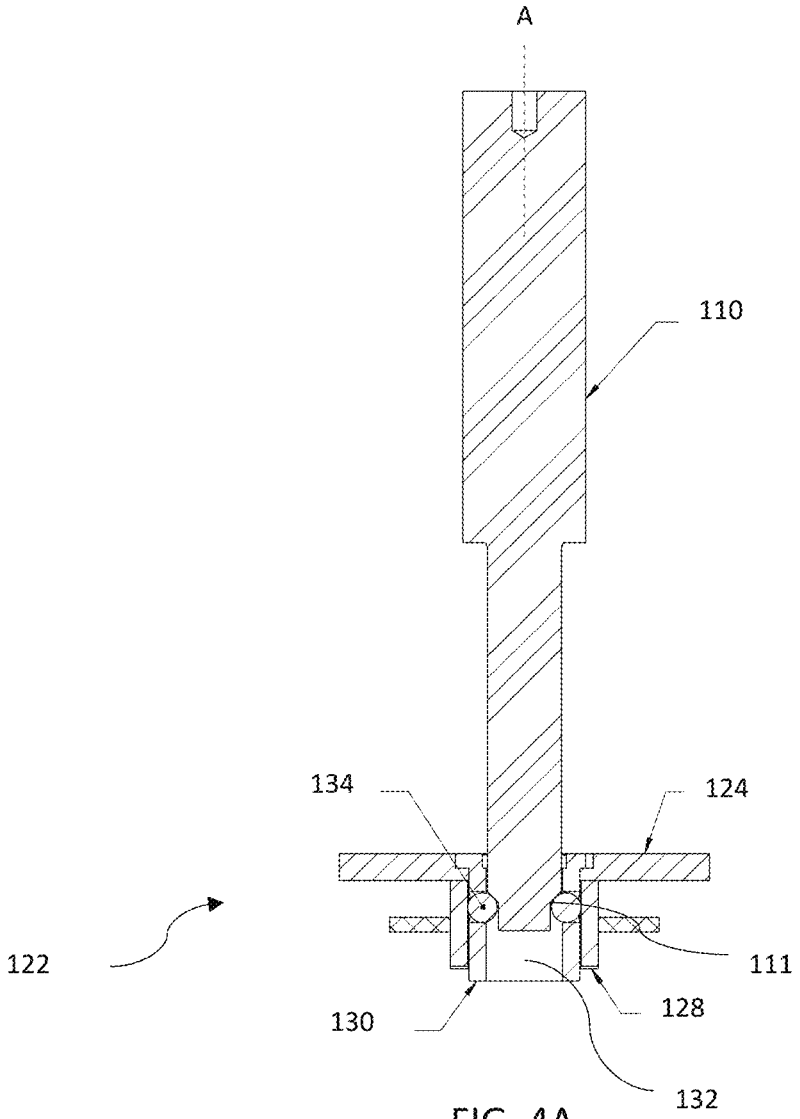
FIGS. 4A-4D schematically illustrate the movement and positioning of a locking mechanism of the selector assembly of FIG. 1A.
Figure 4B:
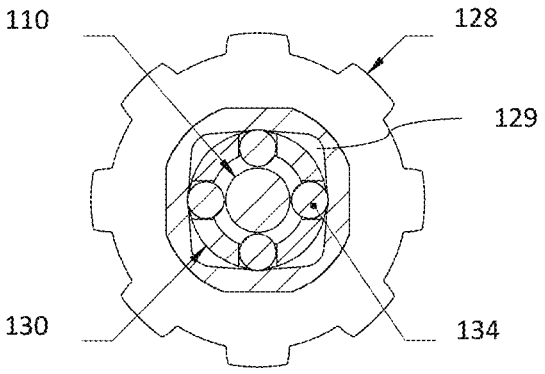
Figure 4C:
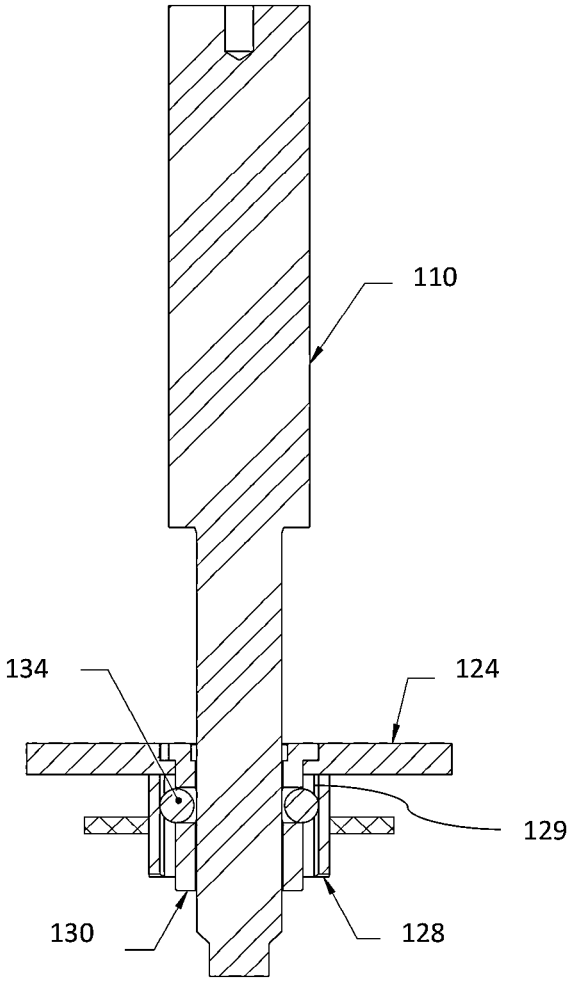
Figure 4D:
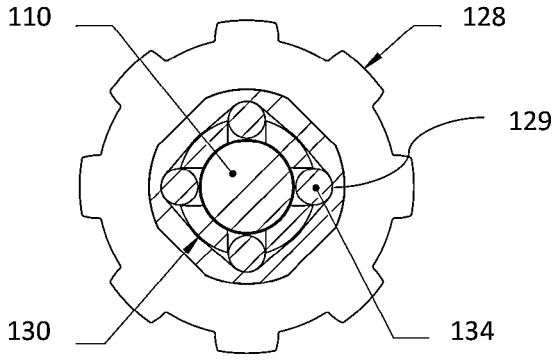

As shown in FIGS. 4A and 4B, the user may first adjust the selector knob 126 (FIG. 3) to select the desired resistance level—for example, by rotating the knob 126 relative to the base unit 124. Each incremental adjustment of the selector knob 126 may rotate the gear ring 128, and thus the retainer member 130, a preselected number of degrees about the central axis A of the spring 110. In embodiments, the preselected number of degrees may be 45 degrees. However, the disclosure contemplates rotation of more or fewer than 45 degrees. As it rotates, the retainer member 130 may move into a first position that forces the ball bearings 134 into the translation path of the springs 110 as they partially enter the bore 132 and engage with the tapered region 111 of the springs 110. This movement of the ball bearings 134 prevents the springs 110 from passing into the retainer member 130, causing the springs 110 to deflect between the spring-nut bearing 120 and the ball bearings 134. As shown in FIGS. 4C and 4D, as the user continues to adjust the knob 126, the retainer member 130 may then move into a second position, which allows the ball bearings 134 to move out of the translation path of the springs 110 as the taper on the end of the spring 110 pushes the ball bearing 134 radially outward and into the groove 129. This movement of the ball bearings 134 allows the spring 110 to pass through the retainer member 130 such that it can no longer deflect, thus relieving tension on the cable 112.

Figure 5A:
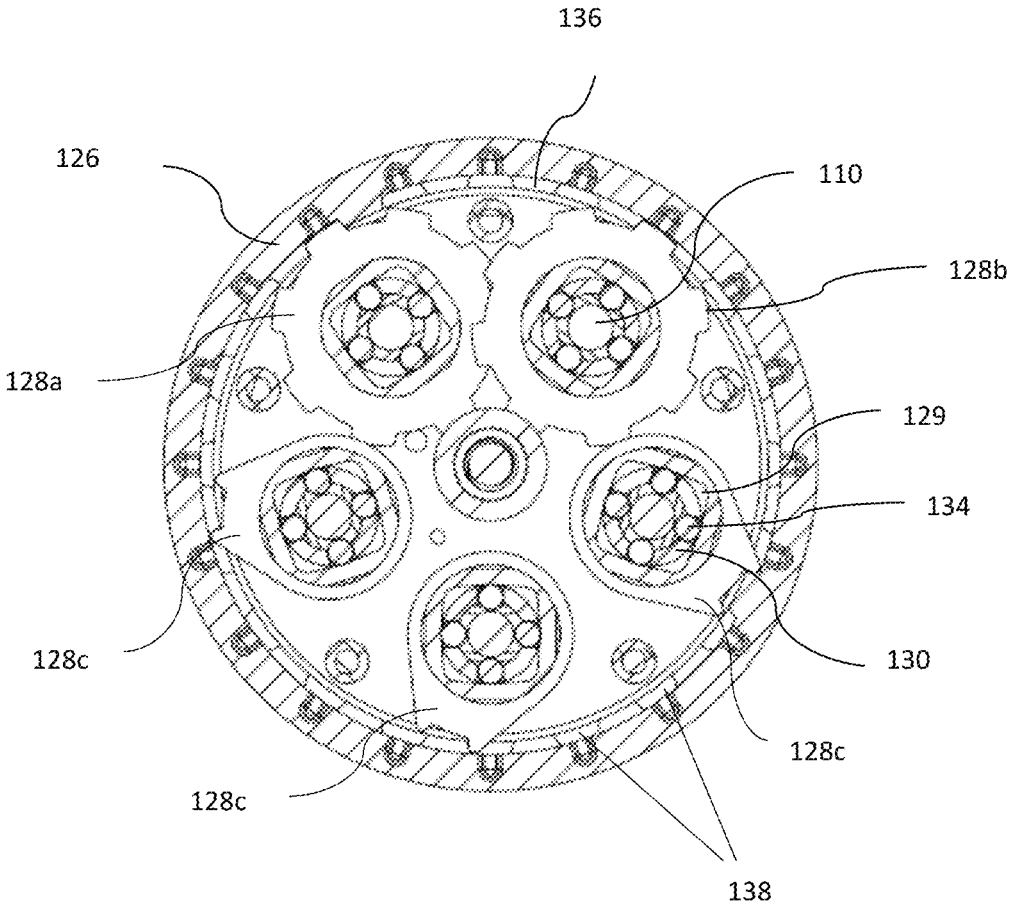
FIGS. 5A and 5B illustrate the selector assembly of FIG. 1A in a section view (FIG. 5A) and a dimetric view (FIG. 5B)
Figure 5B:
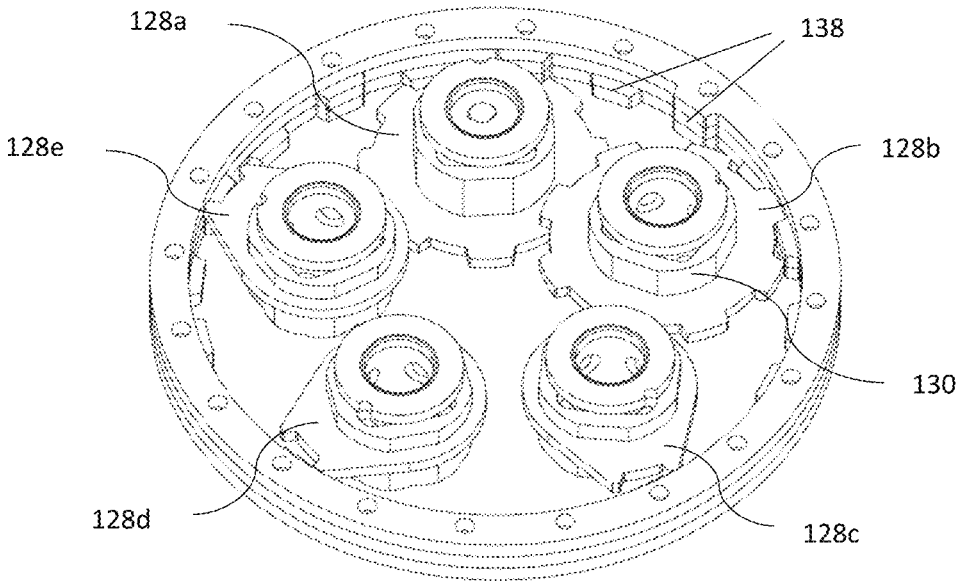

FIG. 5A illustrates a section view of the selector assembly of FIG. 1A. As shown in FIG. 5A, the knob 126 may include an outer gear 136 having a plurality of ribs 138 that are configured to selectively engage with one or more of the gear rings 128*a,b,c,d,e* as the user incrementally adjusts the knob 126. As discussed above, selection or deselection of the gear rings 128*a,b,c,d,e* may create a specific resistance on the cable 112 depending on whether the spring 110 associated with the gear ring 128*a,b,c,d,e* is allowed to deflect or is prevented from deflecting. For example, as shown in FIG. 5B, a height of the ribs 138 may vary relative to an inner wall of the outer gear 136. In turn, a position of the gear rings 128*a,b,c,d,e* along a length of the retainer member 130 may also vary such that, as the user adjusts the knob 126, some of the gear rings 128*a,b,c,d,e* may engage a rib 138 to move the retainer member 130 between the first and second positions, while other gear rings 128*a,b,c,d,e* pass above the ribs 138 and thus do not engage the ribs 138. For example, gear ring 128*a* may be positioned to engage each rib 138, while gear ring 128*b* may be positioned to engage every other rib 138. Gear ring 128*c* may be positioned to engage only a single rib 138, while gear ring 128*d* may be positioned to engage a different single rib 138. Gear ring 128*e* may be positioned such that it does not engage any ribs 138. Examples of gear rings 128*c,d,e* may have a different outer configuration from gear rings 128*a,b* (as shown) or may have a same outer configuration as gear rings 128*a,b*.

Figure 6C:
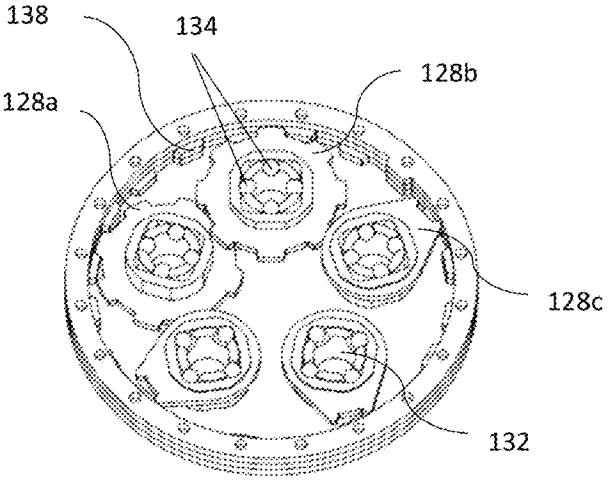
FIGS. 6A-6C illustrate the relative positioning of an intermittent gearing system of the selector assembly shown in FIG. 1A.
Figure 6B:
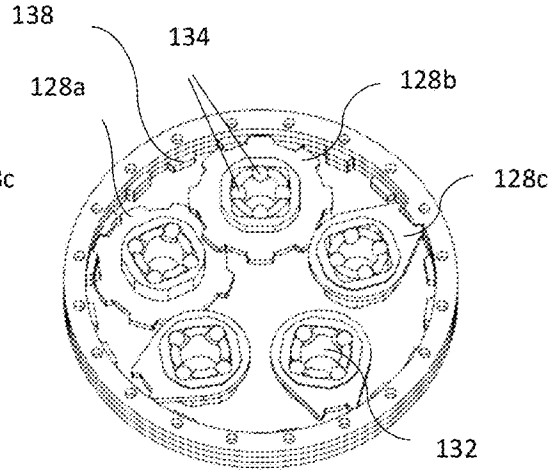
Figure 6A:
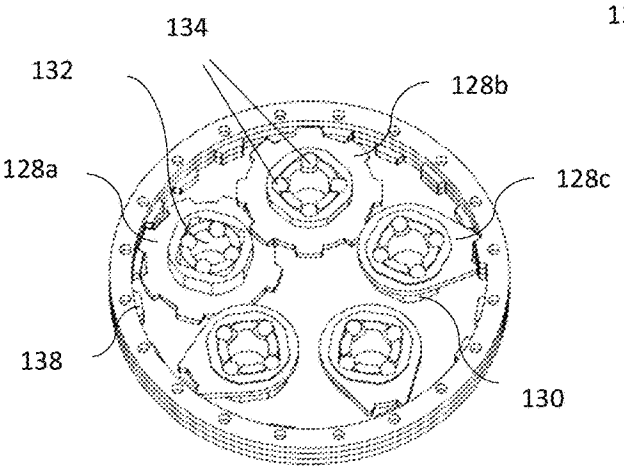

FIGS. 6A-6C illustrate the relative positioning of the intermittent gearing system of the disclosure as the user adjusts the knob 126—for example, by rotating the knob 126 counterclockwise. As shown in FIG. 6A, in a first rotational position of the knob 126, the ball bearings 134 associated with gear ring 128*a* may be positioned within the bore 132 of the retainer member 130, while the ball bearings 134 associated with gear rings 128*b* and 128*c* may be positioned outside of the bore 132. In a second rotational position of the knob 126, shown in FIG. 6B, gear ring 128*a* may rotate upon engaging a rib 138 and thus rotate a position of the retainer member 130 to move the ball bearings 134 outside of the bore 132. Meanwhile, gear rings 128*b* and 128*c* may also rotate upon engaging a rib 138 to move the ball bearings 134 inside the bore 132, resulting in a greater retraction force on the cable 112 compared to the first rotational position. Finally, in a third rotational position of the knob 126, shown in FIG. 6C, gear ring 128*a* may again rotate upon engaging a rib 138 and thus the ball bearings 134 may again move inside of the bore 132. Gear rings 128*b* and 128*c* may remain in position (having not engaged a rib 138 during rotation of the knob 126), and therefore their associated ball bearings 134 may remain positioned inside the bore 132. This results in a greater retraction on the cable 112 compared to the second rotational position.

Figure 7A:
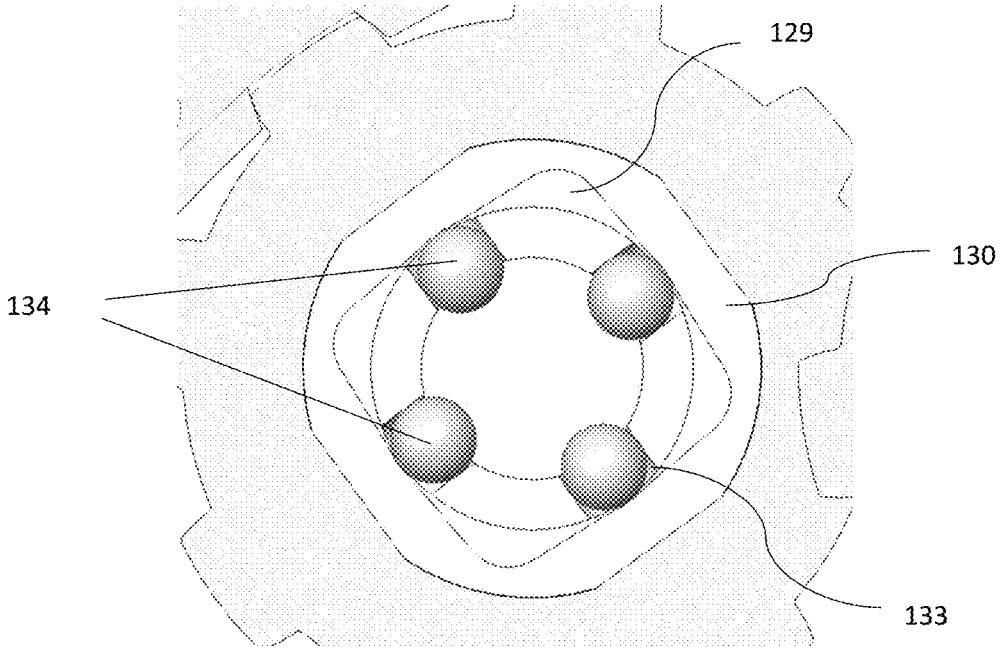
FIGS. 7A and 7B illustrate detailed views show a first configuration of a locking mechanism of the selector assembly shown in FIG. 1A.
Figure 7B:
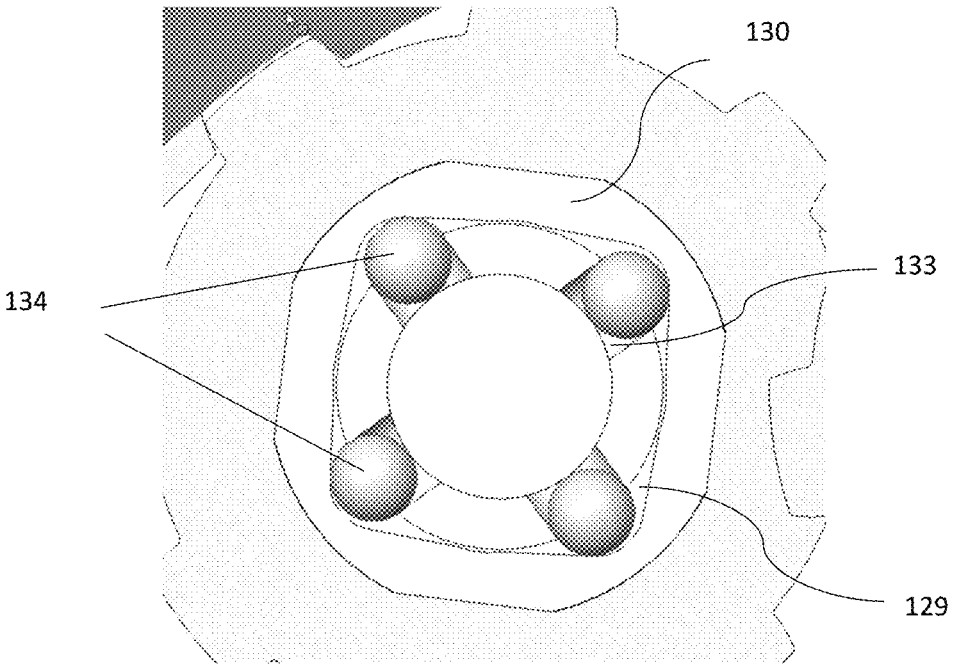
Figure 8A:
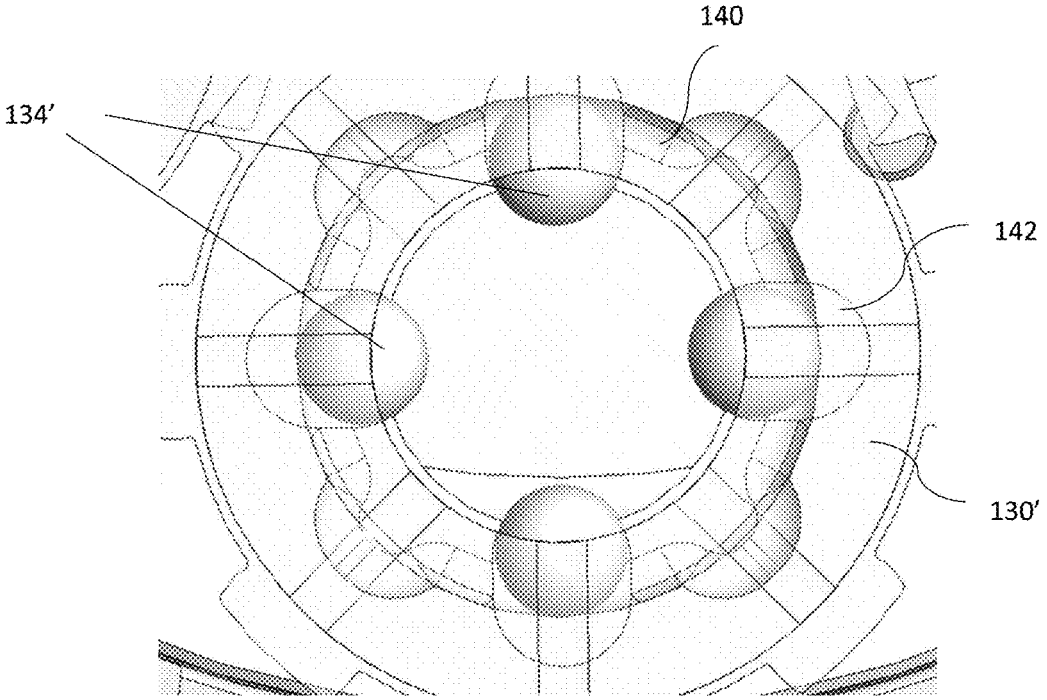
FIGS. 8A and 8B show a second configuration of a locking mechanism of the selector assembly shown in FIG. 1A.
Figure 8B:
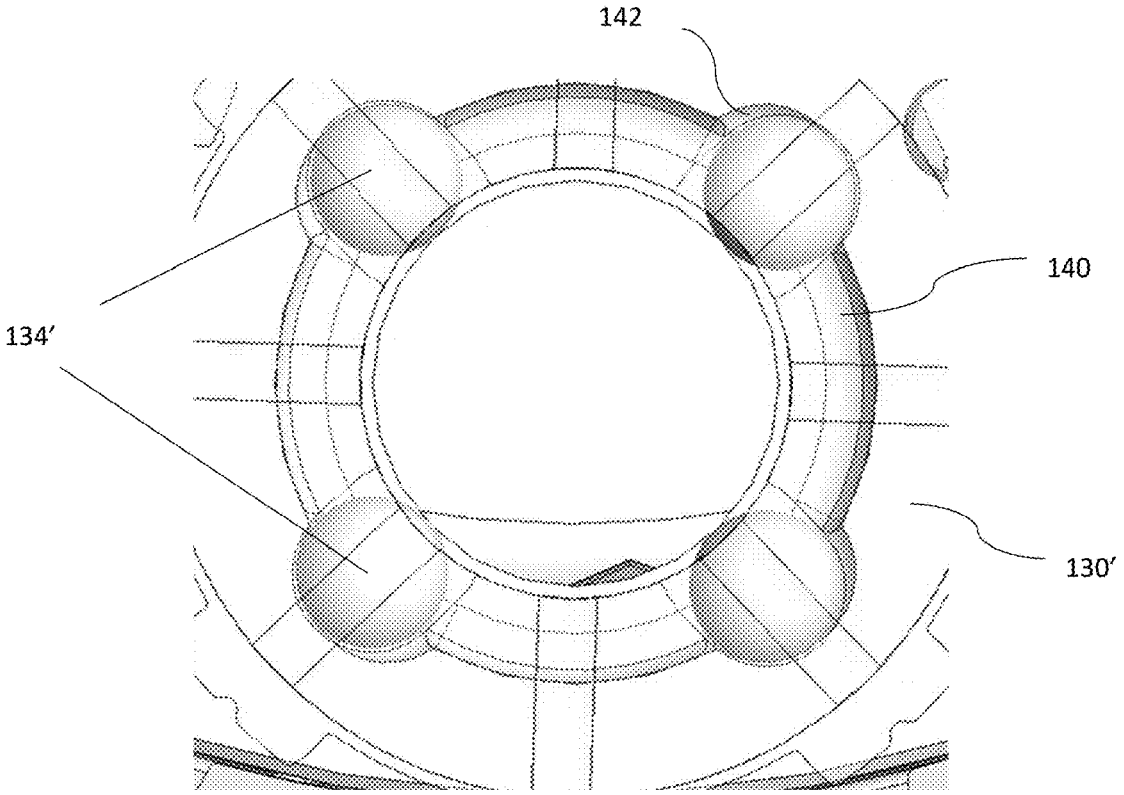

FIGS. 7A and 7B are detailed views of the first configuration of the locking mechanism shown in FIGS. 4A-4D. As shown in FIGS. 7A and 7B, ball bearings 134 may remain positioned within the holes 113 during rotation of the retainer member 130. Rotation of the retainer member 130 may allow the ball bearings 134 to be pushed by the spring 110 into the grooves 129 when the holes 133 are aligned with the grooves 129. In a second configuration of the locking mechanism, shown in FIGS. 8A and 8B, ball bearings 134' may travel along a track 140 during rotation of the retainer member 130'. Rotation of the retainer member 130' may allow the ball bearings 134' to be pushed by the spring 110 into recesses 142 in the retainer member 130' when the ball bearings 134' are aligned with the recesses 142.

In alternative embodiments of the assembly 100, not shown, the spool 108 may be fixed to the ball screw 104 rather than the ball nut 106, while the ball nut 106 may be fixed relative to the selector assembly 122. In this embodiment, the spool 108 and the ball screw 104 translate together to deflect the springs 110, rather than the spool 108 and the ball nut 106. In other embodiments, the assembly 100 may use a form of rollers or bearings on an outer diameter of the spool 108 and a helical shaped groove on the interior of the housing to create the same rotating and translating motion achieved by the ball screw 104. In other embodiments, resistive elements of the assembly 100 may be mounted in series, or the springs 110 may be compounded, rather than being arranged in a parallel configuration, or both.

While the disclosure particularly shows and describes preferred embodiments, those skilled in the art will understand that various changes in form and details may exist without departing from the spirit and scope of the present application as defined by the appended claims. The scope of this present application intends to cover such variations. As such, the foregoing description of embodiments of the present application does not intend to limit the full scope conveyed by the appended claims.

We claim:

1. A cable training assembly for use with an exercise device, the cable training assembly comprising:
- a cable configured for pulling by a user; and
- a screw mechanism operatively coupled to the cable, the screw mechanism configured to deflect at least one spring;
- wherein the deflection of the at least one spring exerts a retraction force on the cable; and
- wherein the at least one spring is selectively engageable with a selector assembly.

2. The cable training assembly of claim 1, wherein the cable training assembly is disposed within a portable housing.

3. The cable training assembly of claim 1, wherein the screw mechanism is a ball screw assembly comprising a threaded ball screw at least partially extending through an internally threaded ball nut.

4. The cable training assembly of claim 3, wherein the cable is wound about a spool mounted to the screw mechanism such that the pulling of the cable by the user causes rotational and translational movement of the spool relative to the ball screw.

5. The cable training assembly of claim 3, wherein the cable is wound about a spool mounted to the screw mechanism such that the pulling of the cable by the user causes the rotational movement of the spool relative to the ball nut.

6. The cable training assembly of claim 3, wherein a spool is mounted to one of the ball screw and the ball nut.

7. The cable training assembly of claim 1, wherein the selector assembly includes a user-engageable member, and wherein adjustment of the user-engageable member selectively engages and disengages the at least one spring.

8. The cable training assembly of claim 7, wherein the user-engageable member is a rotatable knob.

9. The cable training assembly of claim 1, wherein the selector assembly selectively engages and disengages the at least one spring via an intermittent gearing system.

10. The cable training assembly of claim 9, wherein the intermittent gearing system comprises an outer gear on a knob of the selector assembly configured to engage a gear ring associated with the at least one spring.

11. The cable training assembly of claim 1, wherein the at least one spring is a nitrogen spring.

12. The cable training assembly of claim 1, wherein the deflection of the at least one spring comprises compression of the at least one spring.

13. The cable training assembly of claim 1, wherein the deflection of the at least one spring comprises extension of the at least one spring.

* * * * *